United States Patent [19]

Jay

[11] Patent Number: 4,780,940

[45] Date of Patent: Nov. 1, 1988

[54] VIEWING POUCH PARTICULARLY FOR BODIES DEAD OF A COMMUNICABLE DISEASE

[76] Inventor: William G. Jay, 149 Circuit Ave., Waterbury, Conn. 06708

[21] Appl. No.: 72,676

[22] Filed: Jul. 13, 1987

[51] Int. Cl.[4] ..... A61G 17/06

[52] U.S. Cl. ..... 27/28; 27/2

[58] Field of Search ..... 27/2, 19, 28; 229/68 C; 383/6, 8, 9, 47, 51, 127; 224/157, 158

[56] References Cited

U.S. PATENT DOCUMENTS

| | | | |
|---|---|---|---|
| 39,291 | 7/1863 | Holmes | 27/2 UX |
| 323,515 | 8/1885 | Marstion et al. | 27/2 |
| 333,142 | 12/1885 | Marston et al. | 27/2 |
| 924,029 | 6/1909 | Barnes | 27/2 |
| 1,096,489 | 5/1914 | Chadwick | 224/157 |
| 2,279,694 | 4/1942 | Martinson | 27/28 UX |

FOREIGN PATENT DOCUMENTS

| | | | |
|---|---|---|---|
| 290595 | 11/1931 | Italy | 27/2 UX |
| 2941 | 10/1890 | Switzerland | 27/28 |
| 531708 | 1/1941 | United Kingdom | 27/28 UX |
| 756492 | 9/1956 | United Kingdom | 27/28 UX |
| 2115690 | 9/1983 | United Kingdom | 383/6 |

*Primary Examiner*—Robert A. Hafer
*Assistant Examiner*—Samuel Rimell
*Attorney, Agent, or Firm*—Dallett Hoopes

[57] ABSTRACT

This viewing pouch is a box made of flexible material having a part of the top panel of flexible transparent material and is suitable for containing a body from pickup at hospital, through funeral service and viewing and on to crematory for cremation. While the unit is of flexible material and may be folded into a compact bundle when empty and later conforms to the dead body in bag-like fashion, elongated elements are adapted to be inserted in loops of fabric on the top panel to stiffen and support the top panel of the pouch to give it a dressy and formal appearance when it is installed in a casket during viewing. The pouch is particularly suited to contain the body of a person dead from a communicable disease, because from hospital through viewing to crematory, the body need not be removed from the pouch. This avoids risks of communicating the disease to others.

11 Claims, 3 Drawing Sheets

VIEWING POUCH PARTICULARLY FOR BODIES DEAD OF A COMMUNICABLE DISEASE

BACKGROUND OF THE INVENTION

1. Field of the Invention

This invention relates to a body viewing pouch. More specifically, this invention relates to a pouch having a viewing window and being fully flexible to receive a dead body at the hospital in the place of the normal body bag, to be used to transport the body to the funeral home for preparation and embalming, to display the body inside the open casket at the funeral service, to contain the body for delivery to the crematory and to be consumed in the cremation process. During the entire process, from hospital to cremation, the body need not be removed from the pouch.

2. Description of the Related Art

The prior art includes body bags which have been flexible and closeable by stitches, for instance, or zippers, and some of these have had windows for viewing of the face for identification of the body. An example is shown in the old U.S. Pat. No. 3,33,142 to James D. Marston, et al., which issued Dec. 29, 1885. This disclosure includes a wire structure inside the bag adapted to hold the window off the face of the deceased. There have also been provided burial cases of metal sometimes adapted to be vacuumized to help preserve the dead body within. Some of these cases have had windows An example of such a device is shown in the U.S. Pat. No. 1,431,727, which issued Oct. 10, 1922 to George W. Dunn. (Copies of these patents are enclosed in compliance with 37 CFR 1.97.)

The present invention serves the purpose of the body bag and burial case, and at the same time is crematable. By way of background, the public's urgent concern with respect to certain communicable diseases now growing by epidemic proportion has demanded strict and careful segregation of any body having died from such a disease from contact with the public. Indeed, even the personnel in some funeral homes have refrained from servicing dead bodies having died from such a disease.

In the past, when a human has died in a hospital or at an accident scene, he has been transported in a zippered funeral body bag to the funeral home where he has been taken out of the body bag, embalmed, made up and laid out in a fabric-lined casket for viewing by the public. After the funeral service the body has been removed from the casket, unless it is intended to cremate the casket with the body, and has been placed in a cremation container and transferred to the crematory. The multiple handling by employees of the hospital and ambulance corps, the funeral home employees and the crematory personnel is clearly unsuitable for the body of a person who has died from a highly contagious disease. It is also highly undesirable that the body itself be exposed to public viewing without some kind of intermediate guard to prevent real or imagined transfer of communicable elements.

SUMMARY OF THE INVENTION

The present invention provides a foldable, flexible-box-like container having a zippered top panel including a transparent window, adapted to be folded flat and transferred to the pickup point attached to a stretcher or gurney. At the pickup point the viewing pouch embodying the invention can be unfolded and zippered open. The dead body can then be received into the pouch and the pouch can then be zippered closed. In the usual manner the pouch can be belted to a stretcher or other transport device. At the funeral home the top panel can be unzipped and flapped open and employees of the funeral home can embalm, dress up and make up the body as necessary without removing the body from the pouch. In the usual case the embalming is done through the carotid artery and the jugular vein, both in the neck, so that there is no need to remove the body from the pouch.

The pouch containing the body can then be lowered into the funeral casket by means of lifting straps which are secured to the pouch, and can be erected by means of elongated elements which support the top panel above the body, the elongated elements extending through transverse pockets in loops extending up from the top panel. Ends of the elongated elements rest respectively on the top of the side walls of the casket. Preferably additional elongated elements fit into elongated pockets on the sides of the transparent part of the top panel. The stiffening and positioning of the top panel by the elongated elements suspends the top panel in rigid-appearing planar condition, and gives the pouch a dressy, substantial and rectangular appearance, at the same time through the window affording a clear view of the upper portion of the body.

After the viewing and service the body-containing pouch may be lifted out of the casket by the straps and transported to the crematory where the body, as well as the pouch, is cremated. During the entire process, the body need not be taken out of the pouch.

BRIEF DESCRIPTION OF THE DRAWINGS

Other obvious features of the invention will be understood from a reading of the following specification, including the claims and the drawings, all of which disclose a non-limiting embodiment of the invention. In the drawings:

DESCRIPTION OF THE PREFERRED EMBODIMENT

Figure 1:
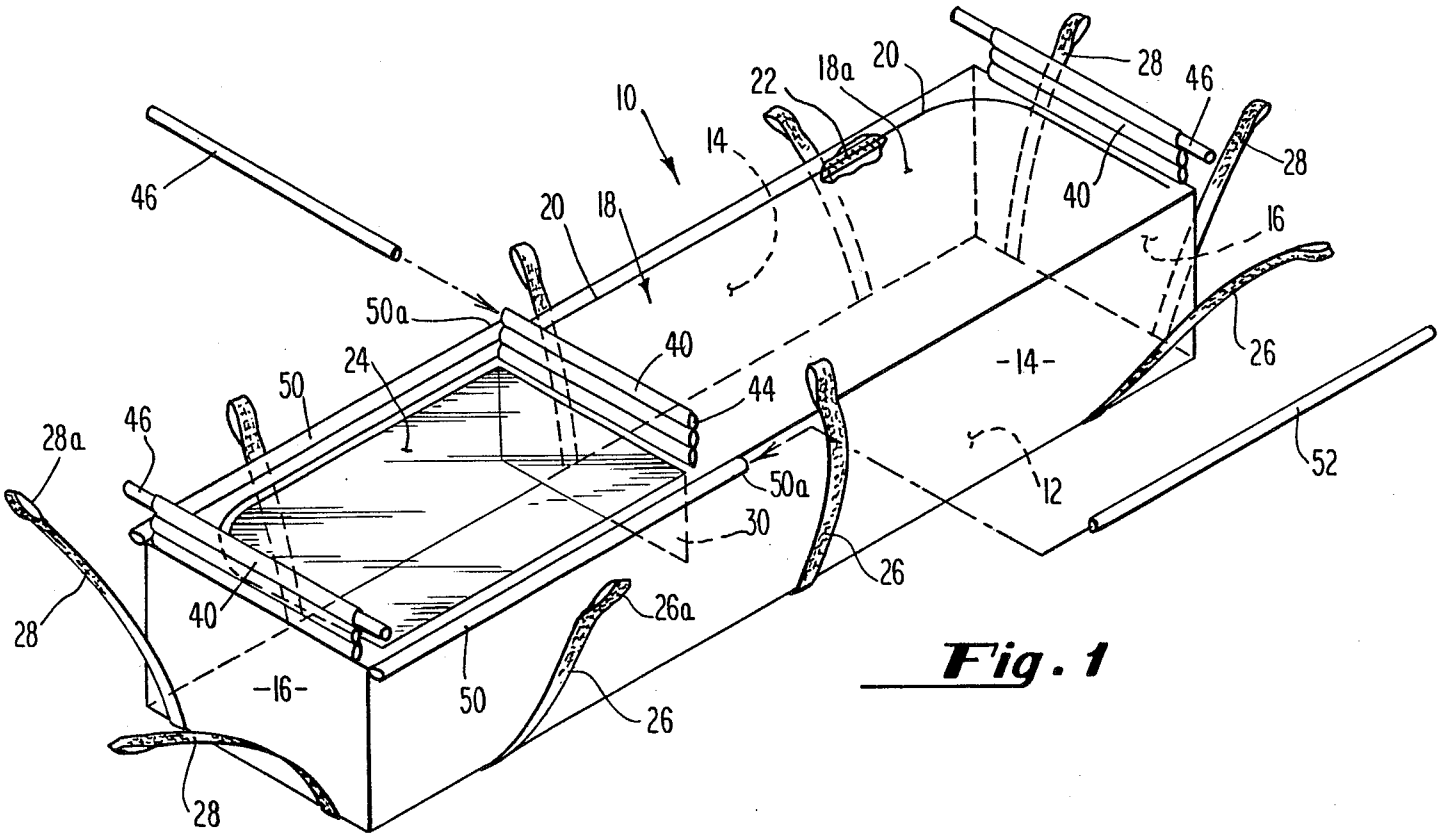
FIG. 1 is a perspective view with parts exploded and partly broken away showing a pouch embodying my invention.

A viewing pouch embodying my invention is shown in FIG. 1 and designated 10. It comprises a bottom panel 12, side walls 14, including end panels 16, and a top panel 18. The top panel is formed with a continuous slit 20 extending about adjacent the ends and rear margin of the top panel to define a flap 18*a*, and a zipper 22, preferably of the plastic-coil type, closes the slit. Part of the flap is provided with a window 24 of flexible vinyl.

Preferably the bottom panel, side panels and top panel are formed from a white 20-gauge vinyl plastic, and the window 24 is of 40-gauge clear vinyl. The bottom panel 12 and the side panels 14, including the end panels 16, are preferably formed from a single piece of vinyl with notches cut out at the corners, so that when the side panels are folded upward they form firm, well-defined corners which may be stitched and heat sealed to prevent leakage. The top panel 18, including the flap 18*a* with window 24, are stitched to the top of the side and end walls. Stitching is preferably double-lock stitch.

Figure 3:
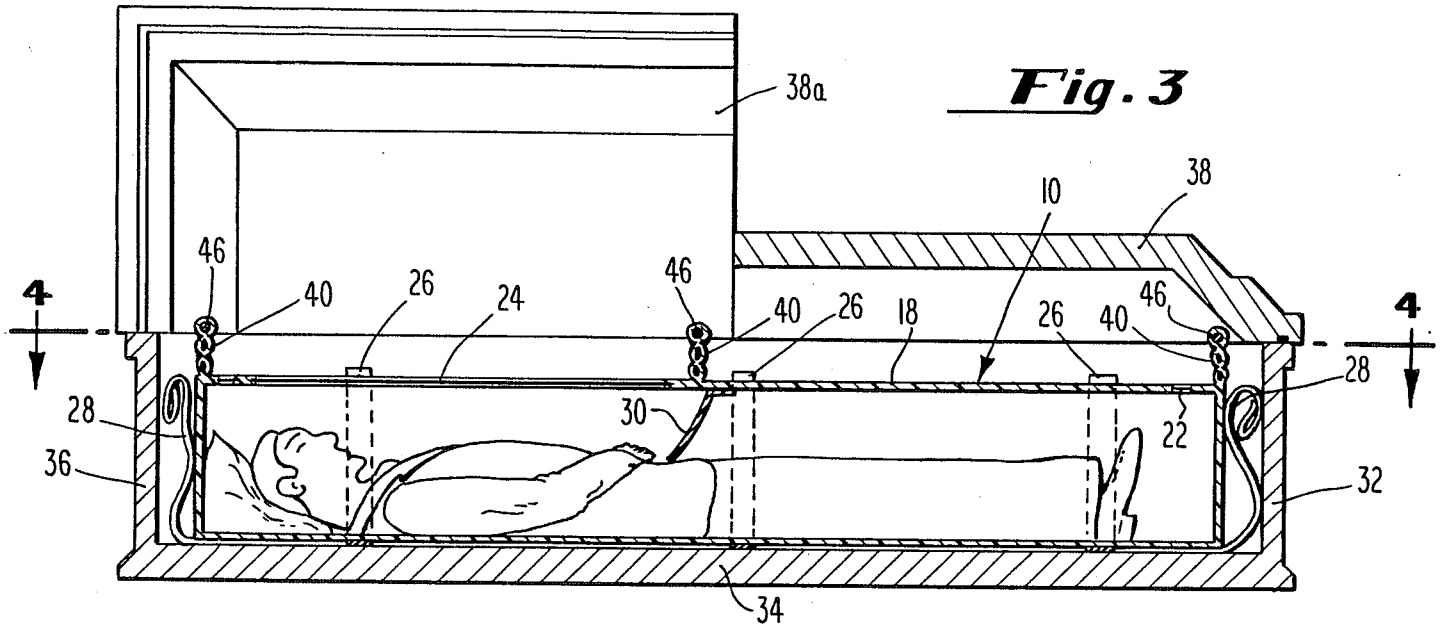
FIG. 3 is a sectional view of the body-containing pouch with the pouch installed in a funeral casket and being fully erected.
Figure 4:
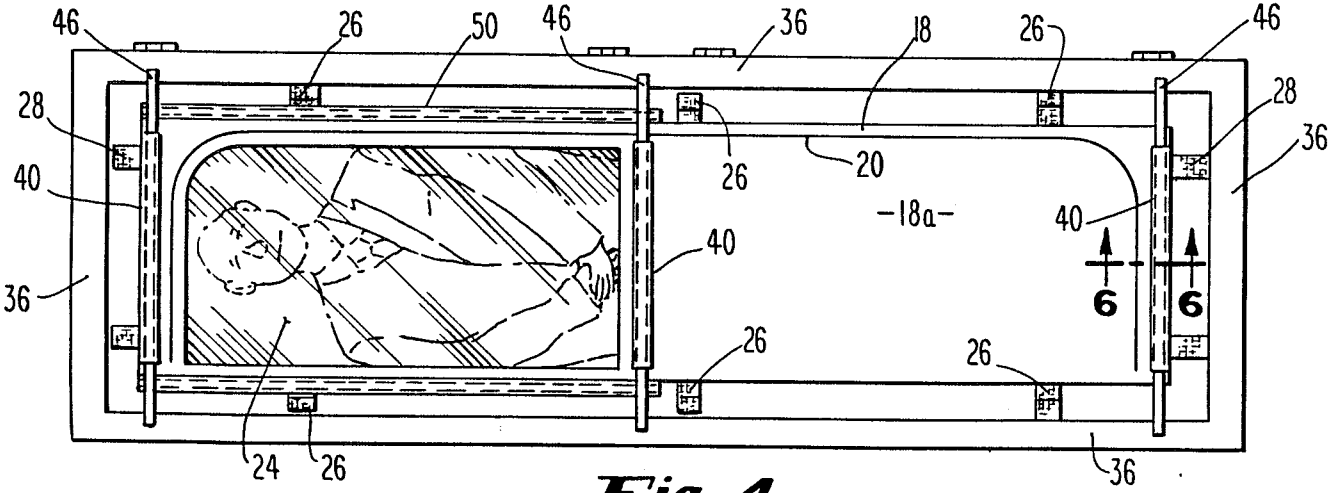
FIG. 4 is a sectional view taken on the line 4-4 of FIG. 3.
Figure 5:
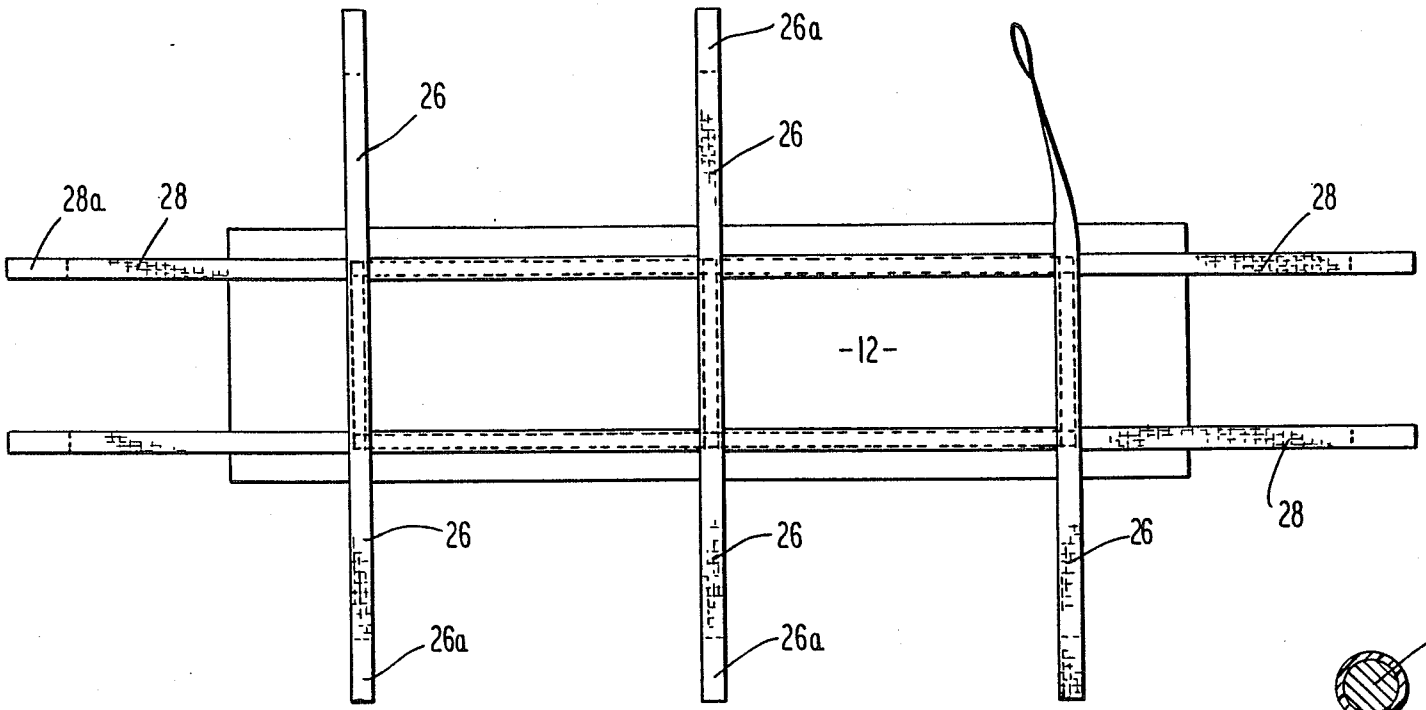
FIG. 5 is a bottom plan view showing the carrying straps secured to the bottom panel of the pouch.

Preferably the slit 20 is cut about the rear of the pouch, as shown in FIG. 1, and the window is disposed on the left-hand side of flap 18*a* to accommodate the usual left-hand viewing position of the head of the deceased in a casket, the left-hand top of which is normally hinged open during viewing (FIG. 3).

Figure 2:
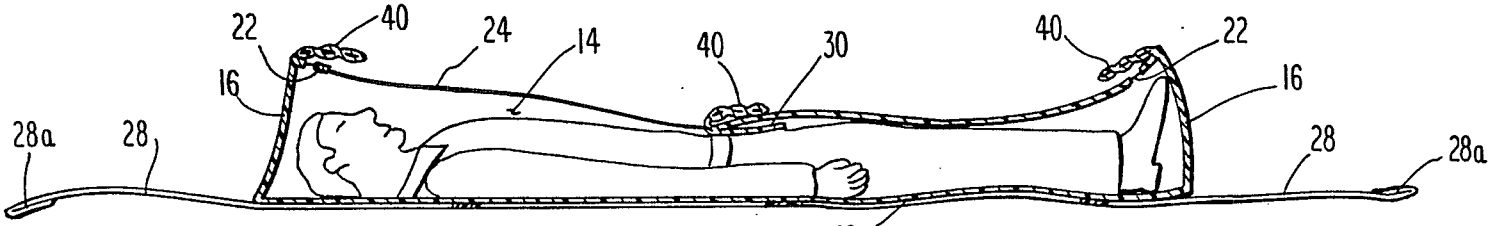
FIG. 2 is a longitudinal sectional view of a pouch containing a body as after hospital pickup without being fully erected.

FIG. 2 demonstrates the flexibility of the pouch not unlike the flexibility of the conventional plastic body bag. If desired, the pouch, as shown in FIG. 2, may be firmly strapped by straps encircling the pouch across the body to secure the body to a stretcher.

Hand straps are provided and comprise the cross straps 26 and the lengthwise straps 28. Each of these straps, which may be woven of nylon or the like, terminates in a redoubled portion, which is stitched or otherwise secured to an adjacent portion of the same strap to form handling loops 26*a* and 28*a*. The straps are adapted for use by conventional funeral home body-lifting apparatus.

Referring to FIG. 3, the viewing pouch 10 of the invention may be, after the preparation of the body, lowered into a casket 32 using the straps. The casket has a base 34, side walls 36 and a top 38, which includes a hinged section 38*a*. In installation of the pouch in a casket, the hand straps 26 and 28 are tucked down between the outside of the pouch and the inside of the casket so as not to be visible. The top 38 is hinged up during installation.

Inside the pouch a shroud or drape 30 hangs down to the right of the window (FIG. 1) to cut off the view of the legs.

Figure 6:
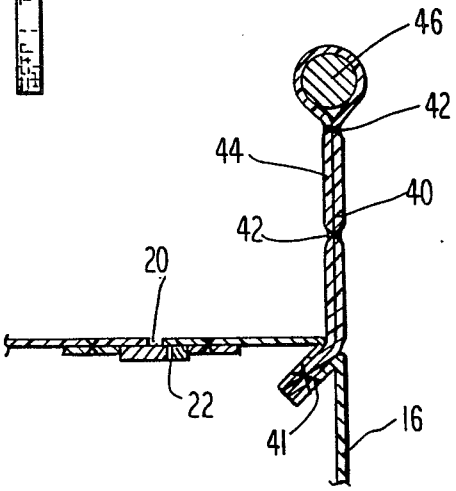
FIG. 6 is an enlarged fragmentary sectional view showing the construction of the flexible loop secured to an end of the pouch.

With the pouch installed in the casket, and the top 38 in place as shown, a feeling of formality and dressiness and neatness of the pouch is obtained by holding the top wall 18 of the pouch suspended in planar condition up away from the body. This is achieved by means of transverse suspension tubes or loops 40, which are stitched as at 41 into the material at the opposite ends of the pouch (FIG. 6) and also across the flap 18*a* of the top panel 18 just to the right of the window 24.

Each of the tubes or loops 40 comprises a doubled-back wide strip of material which has spaced lines of stitching 42 to define three separate tunnels 44. In the erection of the pouch, elongated elements 46 are threaded through a selected tunnel 44, depending on the depth of the casket. More specifically, it will depend on the distance between the supporting floor of the casket, which bears the body, and the top of the side walls 14. Once the elongated elements 46 are installed in the selected tunnels 44*b*, ends of the elements 46 engage and are supported by the top of the side walls 36 of the casket respectively. This support suspends to the panel 18 in planar fashion a spaced distance below the top of the casket.

Additionally, there may be sewn into the pouch along sides of the window 24 the deep narrow pockets 50, which may respectively receive the elongated elements 52. By having the elements 52 installed therein the pockets assure a flat disposition of the window 24 and avoid distortion of the viewing therethrough.

As an embellishment, the open end 50*a* of each pocket 50 may have a snap fastener or Velcro fastener in its mouth so that the pockets may be pinched shut once the elongated elements 52 are installed.

It should be noted that the erection of the pouch as described above can all be accomplished without opening the pouch and thus exposure of funeral home personnel is avoided.

The erection of the viewing pouch, as described, within the casket renders it substantial and well defined, giving it an appearance of formality and dignity, which an ordinary body bag would not have. It is because of this formal appearance that the same viewing pouch, used at the pickup site and on to the crematory, can additionally serve to present the deceased during viewing.

For transport to the crematory the elongated elements 46 and 52 may be removed for subsequent use if desired. Using the straps 26, 28 the now-collapsed pouch, still containing the body, may be removed from the casket. Once at the crematory the entire package may be introduced into the crematory chamber and consumed, pouch and all. All material of the pouch is crematable.

It is envisioned that other forms of the pouch may be structured, and thus the invention is susceptible to various modifications. However, it is believed that the invention is as defined in the following claim language and its equivalents.

I claim:

1. A collapsible viewing pouch comprising an assembly of readily flexible sheet material defined by a bottom panel, side panels and top panel and adapted to fit into a box-shaped burial casket having a base and walls extending upward from the base, the top panel of the assembly having a zipper fastener extending around three sides, so that when the zipper is unzipped the part of the top panel defined by the zipper can be flapped open, said part being of flexible transparent sheet material at least in the area which would be over and align with head and upper torso of a deceased person within the pouch, the top panel having secured across it spaced parallel tubes of flexible sheet material, and a pair of removable rigid elongated elements disposed in the tubes respectively and adapted to have their ends extend beyond the tubes and rest on the tops of the adjacent walls of the casket respectively, whereby the top panel may be suspended from the elements in planar condition to make the pouch appear as a rigid, box-like structure.

2. A collapsible viewing pouch as claimed in claim 1 wherein the pouch is provided on its underside with a plurality of spaced lifting straps extending across the bottom panel and beyond.

3. A collapsible viewing pouch as claimed in claim 1 wherein the tubes are each coextensive with the material of the top panel and the sides of a tube are joined in spaced parallel lines to provide a plurality of tunnels spaced from the top panel by different distances and the elongated elements may be disposed in selected tunnels respectively to space the top panel a desired distance below the tops of the end walls of the casket.

4. A collapsible viewing pouch as claimed in claim 1 including a third tube secured across the top panel and attached to the top panel intermediate the ends and adapted to receive a third removable rigid elongated element also having its ends resting on the tops of the respective adjacent walls of the casket.

5. A collapsible viewing pouch as claimed in claim 1 including a pair of elongated pockets of flexible material attached to the top panel on either side of the transparent sheet material, and receiving elongated rigid elements respectively to hold the transparent sheet material flat.

6. A collapsible viewing pouch as claimed in claim 5 including fastener means secured to the open ends of the pockets respectively.

7. For use in a funeral casket, a viewing pouch adapted to enclose a dead body, the pouch being made entirely of flexible sheet material having a bottom panel, side panels and a top panel with a window of transparent flexible material, shaping means selectively activateable entirely from the outside of the pouch, for causing the entire top panel to assume a planar condition spaced above the dead body, wherein the shaping means comprising spaced parallel tubes of flexible sheet material secured across the top panel and rigid elongated elements extending through the tubes respectively, each of the elements having its opposite ends resting on the top of the side walls respectively of the casket.

8. A viewing pouch as claimed in claim 7 wherein the shaping means comprises suspension loops on the opposite ends of the top panel of the pouch and rigid elongated elements extending through the loops, each of the elements having its opposite ends rest on the top of the side walls respectively of the casket.

9. A viewing pouch as claimed in claim 7 wherein deep narrow pockets of flexible material are disposed on either side of the window and open to the outside of the pouch, and secondary rigid elongated elements are removably disposed in the pockets respectively to stiffen the top panel in the area of the window.

10. Body-viewing apparatus including a funeral casket comprising a container having a bottom wall and upstanding side walls, and a viewing pouch disposed in the casket and comprising a closed container adapted to contain a dead body and made of flexible sheet material comprising a bottom panel, side panels and a top panel, the top panel having a transparent window part, and shaping means for holding the top panel in planar condition above the body and comprising spaced, parallel tubes of flexible sheet material secured across the top panel and rigid elongated elements extending through the tubes respectively, each elongated element having its opposite ends resting respectively on the opposite side walls of the casket.

11. A body-viewing apparatus as claimed in claim 10 wherein deep narrow pockets of flexible material are disposed on either side of the window and open to the outside of the pouch, and rigid secondary elongated elements are removable disposed in the pockets respectively to stiffen the top panel in the area of the window.

* * * * *